United States Patent [19]

Monsigny

[11] Patent Number: 4,677,716

[45] Date of Patent: Jul. 7, 1987

[54] BUCKLE IN PARTICULAR FOR A SAFETY BELT

[75] Inventor: Jean Monsigny, Saverne, France

[73] Assignee: Aciers et Outillage Peugeot, Audincourt, France

[21] Appl. No.: 869,787

[22] Filed: Jun. 2, 1986

[30] Foreign Application Priority Data

Jun. 10, 1985 [FR] France ..... 85 08755

[51] Int. Cl.[4] ..... A44B 11/25

[52] U.S. Cl. ..... 24/641; 24/639; 24/643

[58] Field of Search ..... 24/641, 639, 640, 642, 24/643, 650, 652

[56] References Cited

U.S. PATENT DOCUMENTS

| | | | |
|---|---|---|---|
| 2,893,088 | 7/1959 | Harper et al. . | |
| 4,001,532 | 1/1977 | Kubota et al. | 24/641 |
| 4,094,046 | 6/1978 | Takada | 24/639 |
| 4,451,958 | 6/1984 | Robben et al. | 24/641 |

FOREIGN PATENT DOCUMENTS

| | | | |
|---|---|---|---|
| 14787 | 11/1971 | Australia . | |
| 40143 | 11/1981 | European Pat. Off. | 24/641 |
| 40132 | 11/1981 | European Pat. Off. | 24/641 |
| 0114332 | 8/1984 | European Pat. Off. . | |
| 452367 | 5/1968 | Fed. Rep. of Germany . | |
| 2740458 | 3/1979 | Fed. Rep. of Germany . | |
| 2807575 | 8/1979 | Fed. Rep. of Germany . | |
| 2828082 | 1/1980 | Fed. Rep. of Germany . | |
| 2326209 | 4/1977 | France | 24/641 |
| 2027790 | 2/1980 | United Kingdom | 24/641 |
| 2071753 | 9/1981 | United Kingdom . | |

*Primary Examiner*—Victor N. Sakran

*Attorney, Agent, or Firm*—Sughrue, Mion, Zinn, Macpeak & Seas

[57] ABSTRACT

This buckle, which is intended in particular for the safety belt of a motor vehicle, has a housing (1) inside which there is located a body (4) intended to be fixed to a retaining means integral with the vehicle, a locking member (5) intended to keep the latch in a locked position, and a lock release member (6). The locking member (5) is mounted inside the said body (4) so as to oscillate and be displaceable between a position where the said latch is locked and a position where the latter is released and has at its ends means intended to co-operate with stopping surfaces of the body (4) and of the latch via the action of a destabilizing device (16).

11 Claims, 8 Drawing Figures

FIG.1
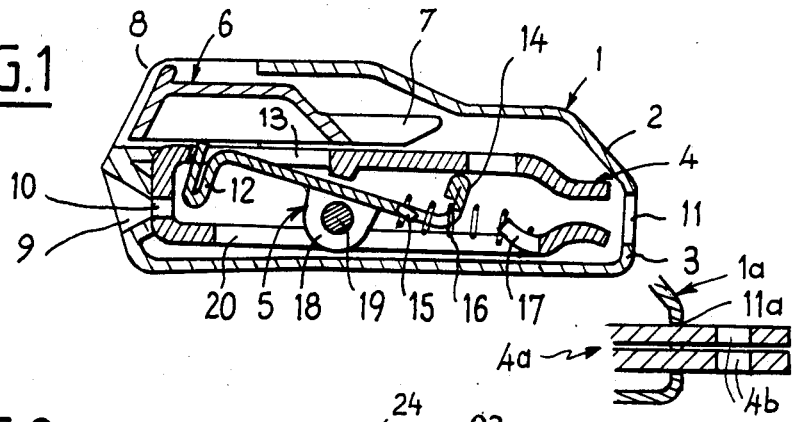
FIG.1a
FIG.2
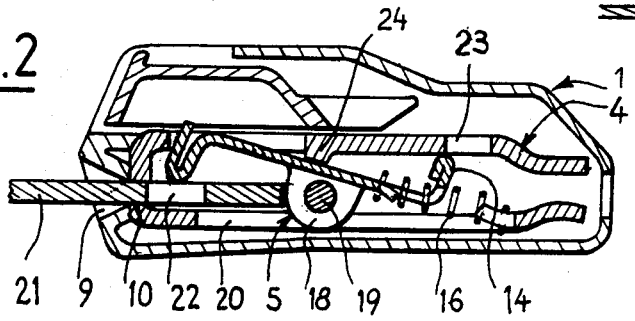
FIG.3
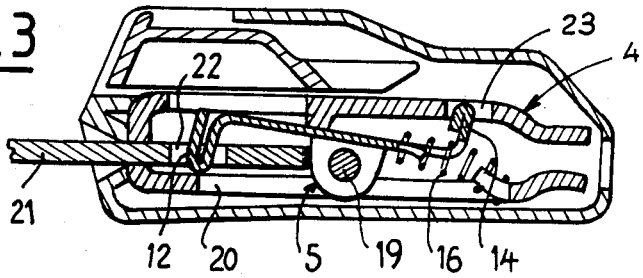
FIG.4
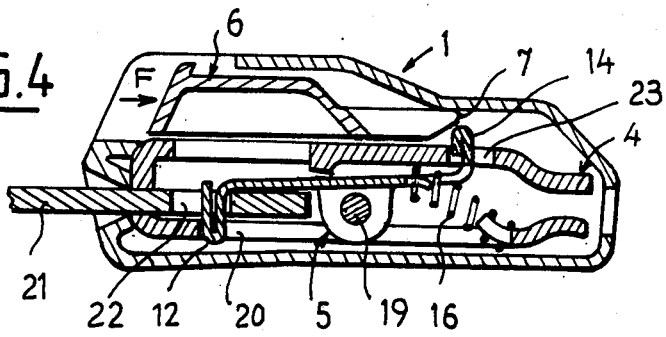

FIG.5
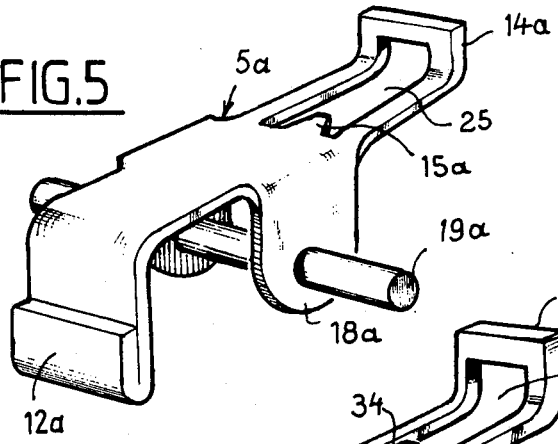
FIG.6
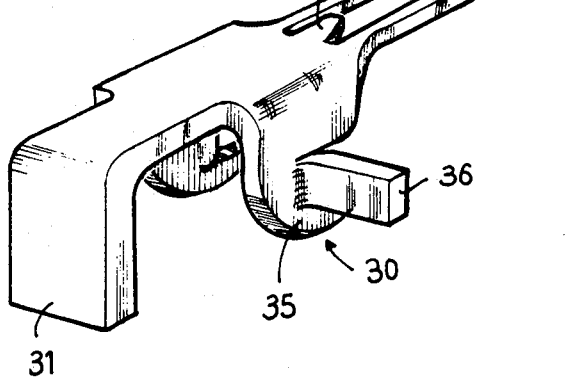
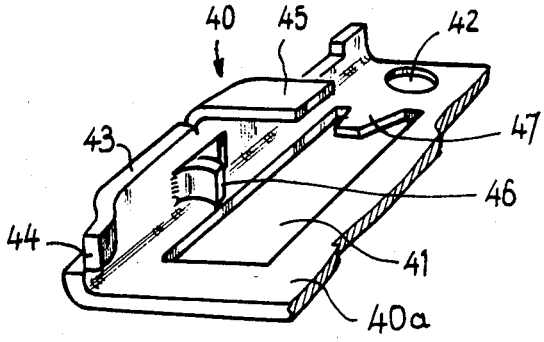
FIG.7

BUCKLE IN PARTICULAR FOR A SAFETY BELT

The present invention relates to devices intended to keep a passenger of a motor vehicle fixed to his seat in the event of sudden deceleration of the vehicle, for example during emergency braking or a collision.

More particularly, the invention concerns a buckle which, in a device of the kind indicated, is intended to fix in a removable manner one end of a safety belt to a fixed point of the vehicle body, for example by means of a tongue forming the latch of a lock.

According to the present state of the art, buckles are known which have a housing inside which there is located a support in the form of a stirrup which is intended to be fixed to a retaining means fixed in relation to the vehicle body and which defines between its flanges a guiding channel for the latch, emerging at one end of this stirrup. These buckles have, in addition, a locking member oscillatably mounted in the stirrup about a pin which is perpendicular to the flanges of this stirrup and also a stop member which is slidably mounted in these flanges and can be made inoperative by means of an operating button, against the action of an elastic return device.

In these types of buckles, the latch is retained inside the buckle by a projecting part of the locking member which prevents withdrawal of the latch from the locking channel, for example by means of insertion into an opening provided in the latch. When a strong pulling action is exerted on the belt, tending to pull out the latch from the buckle, this projecting part co-operates with a stopping edge provided in the bottom of the support stirrup, if necessary by means of elastic deformation of the pin about which the locking member oscillates inside the stirrup, thereby ensuring that the buckle has a very effective action and the latch a considerable retaining force.

The document FR-2,482,430 also discloses a safety-belt buckle comprising a support intended to be fixed to a retaining means and defining a rectilinear passage into which the latch may be introduced and which defines a sliding point for the latter. The member for locking the latch is hingeably mounted on the support about a pin which extends parallel to the plane of the passage. This locking member may have a first bearing surface retaining the latch and extending perpendicularly to the plane of the passage, being transverse in relation to the latter, in the locked position of the buckle, while the locking member may also have at least a second bearing surface which is intended, in the locked position of the buckle, to come into contact with a stop member mounted so as to be movable in translation on the support in a direction perpendicular to the hinge pin of the locking member. Displacement of this stop member releases the locking member and hence the latch during opening of the buckle, which is operated by means of an operating button mounted on the support so as to be able to move in the same direction as the stop member.

Return springs are provided so as to be able to act on the locking member, the stop member and the operating button. The stop member consists of a single-piece body having members for guiding and holding the springs extending on either side of this body in opposite directions perpendicularly in relation to the hinging axis of the locking member.

The design of such devices has a certain number of drawbacks particularly with regard to the observance of fairly small tolerances during manufacture, which thus increases the manufacturing cost of such devices. Moreover, in modern motor-car technology, it is desirable to reduce as far as possible the weight and the dimensions of parts at all levels and in particular in the area of safety equipment without, of course, thereby sacrificing the efficiency of this equipment.

The object of the invention, therefore, is to provide a safety-belt buckle which has a simple design and can be easily assembled, while reducing the number of parts which make up such a buckle.

Another object of the invention is to provide a safety-belt buckle which is smaller and lighter than the buckles of the prior art and which can be manufactured without having to observe small tolerances.

Accordingly, the invention relates to a buckle in particular for the safety belt of a motor vehicle, which buckle is intended to fix in a removable manner one end of the said belt to a fixed point of the vehicle body by means of a latch forming a lock integral with the end to be fixed, the said buckle having a housing inside which there is located a body intended to be fixed to a retaining means integral with the vehicle and which defines a rectilinear passage into which the latch may be introduced and, in addition, a locking member intended to keep the latch in a locked position and a member for releasing the latch, characterized in that the locking member is mounted inside the said body so as to oscillate and be slidably displaceable between a position where the said latch is locked and a position where the latter is released and in that it has at its ends means intended to co-operate with stopping surfaces of the body and of the latch via the action of a destabilising device.

The invention will be better understood with the aid of the description which is given below with reference to the attached drawings which are provided solely by way of example and in which:

FIGS. 1, 1*a*, 2, 3 and 4 illustrate the operation of a safety-belt buckle according to the invention;

FIG. 5 shows a first embodiment of a locking member forming part of a safety-belt buckle according to the invention;

FIG. 6 shows a second embodiment of a locking member forming part of a safety-belt buckle according to the invention; and FIG. 7 is a partial view of a first embodiment of a body forming part of a safety-belt buckle according to the invention.

As shown in FIG. 1, a safety-belt buckle according to the invention comprises a housing 1 consisting, in a manner known per se, of an upper element 2 and a lower element 3. Inside this housing 1 there is arranged a body 4 which, in longitudinal section, has the general shape of an elongated C. A locking member 5, which will be described in more detail below, is accommodated inside this body 4. A lock release member 6, which has an end in the form of a ramp 7, is slidably arranged between the body 4 and the upper element 2 of the housing 1.

As can be seen, the housing 1 has a first aperture 8 into which there leads one end of the lock release member 6 so that the user of the safety-belt buckle has access to this member 6.

The housing 1 also has a first opening 9, the walls of which are inclined, leading to an orifice 10 provided in the body 4. As will be seen below, this opening 9 and this orifice 10 define a passage for a tongue for example, forming a latch integral with an end of the safetybelt to be fixed.

The housing 1 also has a second opening 11 provided in the end of the housing 1 opposite the end in which the opening 9 is provided. This opening 11 is arranged facing the ends of N.B. two walls forming the body 4. This opening 11 is intended to allow the passage of a retaining means (not shown), one end of which is fixed to the vehicle and the other end of which is fixed to the body 4 so as to make the body 4 integral with the vehicle.

As shown in FIG. 1*a*, the ends of the two walls forming a body 4*a* may project outside a housing 1*a* through an opening 11*as* provided in the end of the housing 1*a* opposite the end in which an opening is provided allowing the latch to be introduced into the buckle.

These ends are provided with recesses 4*b* intended to allow the body 4*a* to be fixed to a retaining means integral with the vehicle.

This design of the buckle makes for greater 35 versatility of the latter.

As for the locking member 5, it has a first projection 12 which, in the position shown in FIG. 1, extends through an aperture 13 provided in the upper wall of the body 4 opposite the lock release member 6. In this position, the first projection 12 is therefore arranged above the passage defined by the opening 9 of the housing 1 and the orifice 10 of the body 4. This locking member has, at its other end, a second projection 14 which, in the position shown in this Figure, bears against an edge of the upper wall of the body 4. This end of the locking member 5 also has a centring lug 15 on which there is arranged one end of a destabilising device which may consist, for example, of a spring 16, the other end of which rests on a lug 17 which is formed in the lower wall of the body 4 and is inclined towards the inside of the latter, in relation to the direction of displacement of the locking member inside the body 4, as will be seen below.

This spring 16 exerts a force which tends to keep the second projection 14 of the locking member 5 against the upper wall of the body 4 and to push this member 5 so that the first projection 12 of the latter bears against a shoulder of the aperture 13.

In its central part, the locking member 5 has two flanges formed by means of pressing and constituting a single piece with the remainder of the locking member, only one of which 18 is shown and in which there is arranged a pin 19 which, as will be seen below, may be a pin mounted in the flanges of the locking member 5 or a pin formed as a single piece with the latter.

The ends of this pin 19 extend laterally beyond the flanges of the locking member and rest on the shoulders of an aperture 20 provided in the lower wall of the body 4.

As will be described in greater detail below, the locking member 5 is mounted so as to oscillate about this pin 19 and so as to be slidably displaceable inside the body 4.

When a tongue forming a latch 21 (FIG. 2) and having a recess 22 is introduced into the opening 9 provided in the housing and the orifice 10 of the body 4, the end of the said tongue bears against the flanges, for example 18, of the locking member 5 and, if the user exerts a pressure on this latch so as to introduce it into the safety-belt buckle, the locking member 5 is pushed back inside the body 4. These flanges therefore constitute bearing means for the end of the latch so that the latter is able to displace in a slidable manner the locking member. This displacement is possible owing to the fact that the locking member is mounted so as to be slidably displaceable inside the body 4 against the action of the elastic destabilising device consisting of the spring 16. When the locking member 5 is displaced by a certain amount, the projection 14 of the latter is located opposite an aperture 23 provided in the upper wall of the body 4 and defining an edge of the said wall. The spring 16 and, if necessary, a shoulder 24 of the body 4 formed substantially opposite the flanges of the locking member 5 therefore cause the locking member to be displaced angularly about its pin 19 resting on the lower wall of the body 4.

When this angular displacement is sufficient for the destabilising device consisting of the spring 16 to exceed its stable position, the said device imparts a tilting movement (FIG. 3) to the locking member 5. The projection 14 of the latter then penetrates inside the aperture 23 of the body 4 and the projection 12 of this locking member passes through the recess 22 in the latch 21 and bears against a shoulder of the aperture 20.

If sliding displacement of the locking member 5 continues, i.e. if the user continues to act on the latch 21, the projection 12 of the locking member penetrates inside the aperture 20 of the body 4 as a result of the action of the spring 16. In this position, shown in FIG. 4, the projection 14 of the locking member 5 protrudes beyond the upper wall of the body 4, and when the user releases the pressure on the latch 21, the locking member 5 is brought, via the action of the spring 16, into a stable position in which the projection 12 passes through the recess 22 in the latch 21 and bears against a stopping edge of the aperture 20 in the body 4, thereby ensuring that the latch is locked inside the buckle.

The displacement of the locking member inside the body 4 is limited, on the one hand, by the projection 12 bearing against the stopping edge of the aperture 20 and, on the other hand, by the projection 14 bearing against a wall of the aperture 23.

When the user wishes to unlock the safety-belt buckle, he/she operates the lock release member 6, as indicated by the arrow F in FIG. 4, so as to impart to it a sliding movement which brings the ramp 7 of the said member against the projection 14 of the locking member such that the locking member 5 is made to move angularly about the pin 19 so that the projection 12 of the member 5 is disengaged, from the aperture 20 and so that, as a result of the action of the spring 16, the locking member is made to tilt and to move slidably towards the position shown in FIG. 1, where the projection 12 is also disengaged from the recess 22 in the latch 21.

During this movement, the flanges 18 of the locking member 5 push the end of the latch 21 so that the latter is ejected from the safety-belt buckle.

It should be noted that the lock release member 6 is provided with a return spring (not shown) which tends to bring it into the rest position shown in FIG. 1.

The projection 12 ensuring that the latch is retained inside the buckle is subjected to a shearing force when a pulling action is performed on the latch 21. This projection 12 must therefore be able to withstand considerable stresses, as is normally the case in this type of application. Also, different ways of manufacturing the locking member may be envisaged.

As shown in FIG. 5, a locking member 5*a* may be made of thin pressed sheet-metal in which a pin 19*a* is mounted. In this case and as has been shown in the previous Figures, one of the ends of this member has a projection 12*a* ensuring locking of the latch, this projection being doubled so as to possess a sufficient shearing strength. Flanges 18*a* of the locking member have two recesses in which the pin 19*a* is arranged. This pin 19*a* may be force-fitted into the recesses in the flanges 18*a* so that it is integral with the remainder of the locking member or it may be freely rotatable inside these recesses if it is laterally guided inside the body 4. The other end of the locking member 5*a* which has a projection 14*a* is provided with an aperture 25 into which a lug 15*a* for receiving one end of the destabilising device protrudes, in a similar manner to the embodiment described with reference to FIGS. 1 to 4.

Furthermore, and as is shown in FIG. 6, the locking member may be in the form of a pressed piece 30 made of thick sheet metal, one projection 31 of which, ensuring that the latch is retained inside the safety-belt buckle, is not doubled. A projection 32, an aperture 33 and a lug 34 have shapes similar to the projections 14 and 14*a*, to the aperture 25 and to the lugs 15 and 15*a*, respectively, of the preceding embodiments. These elements perform the same role as the corresponding elements already described.

This locking member 30 also has flanges 35 which are made of sheet metal which is thicker than in the previous cases. It is therefore possible to provide projecting parts 36, formed as a single piece with these flanges 35, which perform the same role as the ends of the pins 19 and 19*a*, i.e. which rest on the lower wall of the body 4 so as to allow tilting and sliding displacement of the locking member 30 inside this body 4. In this embodiment, the projecting parts 36 may advantageously have a polygonal cross-section.

FIG. 7 shows an embodiment of a body 40 forming part of safety-belt buckle according to the invention. This body 40 is in the form of a stirrup pressed from a metal plate and having a lower wall 40*a* which has an aperture 41, similar to the aperture 20 shown in FIGS. 1 to 4, and a recess 42 by means of which the body 40 is fixed to a retaining means integral with the vehicle. This body 40 also has two side walls, only one of which 43 is shown and in which a shoulder 44 defining a passage for the latch is formed by means of pressing.

A tongue 45 extends substantially perpendicularly in relation to the side wall 43 so as to form an upper wall of the body, the edges of which perform the same role as the apertures 13 and 23 shown in FIGS. 1 to 4.

In the side wall 43 there is also formed, by means of pressing, a shoulder 46 protruding towards the inside of the body and intended to form a stop for the flanges of the locking member so as to limit its displacement forwards resulting from the action of the spring 16. In fact, the body 40 does not have a bearing surface for the projection ensuring locking of the latch, when the latter is in the unlocked position, an it is therefore necessary to provide means for limiting its forwards displacement.

A lug 47, intended to receive one end of the destabilising device, extends into the aperture 41.

This lug 47 is also inclined towards the inside of the body 40 in relation to the direction of displacement of the locking member inside the said body.

I claim:

1. Buckle in particular for the safety belt of a motor vehicle, which buckle is intended to fix in a removable manner one end of the belt to a fixed point of the vehicle body by means of a latch (21) forming a lock integral with the end to be fixed, said buckle having a housing (1;1*a*) inside which there is located a body (4;4*a*;40) intended to be fixed to a retaining means integral with the vehicle and which defines a rectilinear passage for receiving the latch (21) and, in addition, a locking member (5;5*a*;30) intended to keep the latch in a locked position and a member (6) for releasing the latch, wherein the locking member (5:5*a*; 30) is mounted inside the body (4;4*a*;40) so as to oscillate and be slidably displaceable, in a direction parallel to the direction of displacement of the latch in the body, between a position where the latch is locked and a position where the latter is released and wherein said locking member has at its ends means intended to cooperate with stopping surfaces of the body (4;4*a*;40) and of the latch (21) via the action of a destabilizing device (16), and wherein said means consist of projections (12,14;12*a*,14*a*;31,32) and wherein the locking member has, in its central part, bearing means (18;18*a*;35) for the end of the latch (21) so that the latter is able to displace slidably the locking member (5;5*a*;30) inside the body towards the locked position, against the action of an elastic destabilizing device (16), said locking member (5;5*a*;30) having at one end of a first projection (12;12*a*;31) cooperating in the locked position, via the action of the destabilizing device, with a recess (22) in the latch (21) and with a stopping edge of an aperture (20;41) provided in a first wall of the body (4;40) and at its other end a second projection (14;14*a*;32) cooperating with an edge (23) of a second wall of the body (4;40) opposite the first wall, the end of said second projection (14;14*a*;32) protruding, in the locked position, beyond the second wall and being actuatable by the lock release member (6).

2. Buckle as claimed in claim 1, wherein the bearing means consist of flanges (18;18*a*;35) formed as a single piece, by means of pressing, with the remainder of the locking member (5;5*a*;30).

3. Buckle as claimed in claim 2, wherein the Locking member (5;5*a*;30) is mounted so as to oscillate and be slidably displaceable inside the said body (4;40) by means of projecting parts (19;19*a*;36) extending laterally from the bearing means (18;18*a*;35) of the said locking member (5;5*a*;30), these projecting parts resting on the said first wall of the body (4;40).

4. Buckle as claimed in claim 3, wherein the bearing means consists of flanges (18;18*a*;35) formed as a single piece, by means of pressing, with the rmainder of the locking member (5;5*a*;30).

5. Buckle as claimed in claim 3, wherein the said projecting parts (36) are formed as a single piece with the said bearing means (35).

6. Buckle as claimed in claim 5, wherein the said projecting parts (36) have a polygonal cross-section.

7. Buckle as claimed in claim 3, wherein the said projecting parts consist of the ends of a pin (19;19*a*) arranged in recesses provided in the said bearing means (18;18*a*).

8. Buckle as claimed in claim 5, wherein the said pin (19;19*a*) is rotatably mounted in the said recesses of the bearing means.

9. Buckle in particular for the safety belt of a motor vehicle, which buckle is intended to fix in a removable manner one end of the belt to a fixed point of the vehicle body by means of a latch (21) forming a lock integral with the end to be fixed, said buckle having a housing (1:1*a*) inside which there is located a body (4;4*a*;40) intended to be fixed to a retaining means integral with the vehicle and which defines a rectilinear passage for receiving the latch (21) and, in addition, a locking member (5;5*a*;30) intended to keep the latch in a locked position and a member (6) for releasing the latch, wherein the locking member (5;5*a*;30) is mounted inside the body (4;4*a*;40) so as to oscillate and be slidably displaceable, in a direction parallel to the direction of dsiplacement of the latch in the body, between a position where the latch is locked and a position where the latter is released and wherein said locking member has at its ends means intended to cooperate with stopping surfaces of the body (4;4*a*;40) and of the latch (21) via the action of a destabilizing device (16).

10. Buckle as claimed in claim 1, wherein the destabilizing device consists of a spring (16), one end of which is arranged on a lug (15;15*a*;34) of the locking member (5;5*a*;30) and the other end of which is arranged on a lug (17;47) of the body (4;40), which lug is inclined towards the inside of the latter in relation to the direction of displacement of the locking member inside the said body.

11. Buckle as claimed in claim 1, wherein a part of the body (4*a*) protrudes outside the housing (1*a*) through an opening (11*a*) provided in the end of the housing opposite the end in which there is an opening allowing the latch to be introduced into the buckle, this part of the body having at least one recess (4*b*) intended for fixing the body to a retaining means integral with the vehicle.

* * * * *